United States Patent [19]

Sugiura et al.

[11] 4,285,323

[45] Aug. 25, 1981

[54] TRANSISTORIZED IGNITION APPARATUS FOR DRIVING IGNITION COILS IN AN INTERNAL COMBUSTION ENGINE

[75] Inventors: Noboru Sugiura; Seiji Suda, both of Ibaraki, Japan

[73] Assignee: Hitachi, Ltd., Tokyo, Japan

[21] Appl. No.: 946,865

[22] Filed: Sep. 29, 1978

[30] Foreign Application Priority Data

Sep. 30, 1977 [JP] Japan ..... 52-116924

[51] Int. Cl.[3] ..... F02P 15/08

[52] U.S. Cl. ..... 123/638; 123/609; 123/644

[58] Field of Search ..... 123/148 C, 148 DS, 148 E

[56] References Cited

U.S. PATENT DOCUMENTS

| | | | |
|---|---|---|---|
| 3,392,717 | 7/1968 | Soehner et al. | 123/148 E |
| 3,919,994 | 11/1975 | Munden | 123/148 DS |
| 3,937,193 | 2/1976 | Kim | 123/148 E |
| 4,030,468 | 6/1977 | Sugiura et al. | 123/148 E |
| 4,176,645 | 12/1979 | Jundt et al. | 123/148 E |

*Primary Examiner*—Charles J. Myhre
*Assistant Examiner*—Andrew M. Dolinar
*Attorney, Agent, or Firm*—Craig and Antonelli

[57] ABSTRACT

A transistorized ignition apparatus for driving plural ignition coils of an internal combustion engine comprising two power transistor circuits, each having a power transistor, and a pick-up coil for generating an ignition timing signal synchronized with the rotation of the engine. A wave-form shaping circuit receives the ignition timing signal and determines the conduction period of the power transistors, including the conduction starting point thereof. Two driver circuits, which are provided for respective power transistor circuits, produce driving signals thereto on the receipt of an output from the wave-form shaping circuit. Each power transistor circuit has a current limiter circuit which decreases the base current of the power transistor depending on the amount of the current flowing therethrough. The currents through the power transistors, therefore, are restricted to respective maximum values and the operations thereof are drawn into the non-saturation region. One maximum value is preset lower than the other. A feedback circuit monitors the voltage at the collector of the power transistor, the current through which is restricted under the lower maximum value, and detects the duration of the non-saturated operation thereof. In the wave-form shaping circuit, the conduction period of the power transistors, particularly the conduction starting point, is controlled depending on the output from the feedback circuit.

8 Claims, 5 Drawing Figures

TRANSISTORIZED IGNITION APPARATUS FOR DRIVING IGNITION COILS IN AN INTERNAL COMBUSTION ENGINE

BACKGROUND OF THE INVENTION

The present invention relates to a transistorized ignition apparatus, more particularly to an ignition apparatus for driving a plurality of ignition coils at one time.

A transistorized ignition apparatus for driving plural ignition coils in an internal combustion engine, conventionally, has plural power transistors for driving respective ignition coils. Therefore, inherently there is a problem with heat generated by the power transistors and transferred throughout the apparatus. High temperature, as is well-known in the art, causes problems with transistorized apparatus in general and power transistor is particular.

In order to protect a power transistor and an ignition coil and to make constant a voltage induced across a secondary coil of the ignition coil, a transistorized ignition apparatus has been proposed wherein a conduction starting point of the power transistor is controlled and a primary current of the ignition coil is restricted in U.S. Pat. No. 4,030,468. In being adapted for driving plural ignition coils, however, such apparatus necessarily includes plural feedback elements for controlling the conduction starting points of respective power transistors, thereby resulting in a complex construction and an increase in cost.

SUMMARY OF THE INVENTION

An object of the present invention is to provide a transistorized ignition apparatus for driving plural ignition coils wherein the conduction starting point of the power transistors are accurately controlled by only one feedback element, thereby simplifying the construction and reducing the costs.

Another object of the present invention is to provide a transistorized ignition apparatus free from the drawbacks mentioned above.

These objects mentioned above have been achieved by a transistorized ignition apparatus having, plural power transistor circuits for supplying primary currents to ignition coils, a pick-up for generating an ignition timing signal synchronized with the rotation of an engine, a wave-form shaping circuit for determining the conduction starting point and the conduction period of the power transistors on the basis of the ignition timing signal from the pick-up coil, and driver circuits for providing driving signals to the respective power transistors on receipt of an output from the wave-form shaping circuit. The primary currents of the ignition coils supplied by the power transistor circuits are restricted to their respective maximum values, and there are further provided means for detecting the duration during which one of the power transistors operates in non-saturation region ahead of the others and a feedback means for providing voltage depending on the duration detected by the detecting means to the wave-form shaping circuit. Thus the conduction starting point of the power transistors are controlled in accordance with the voltage from the feedback means.

DETAILED DESCRIPTION OF PREFERRED EMBODIMENTS

Figure 1:
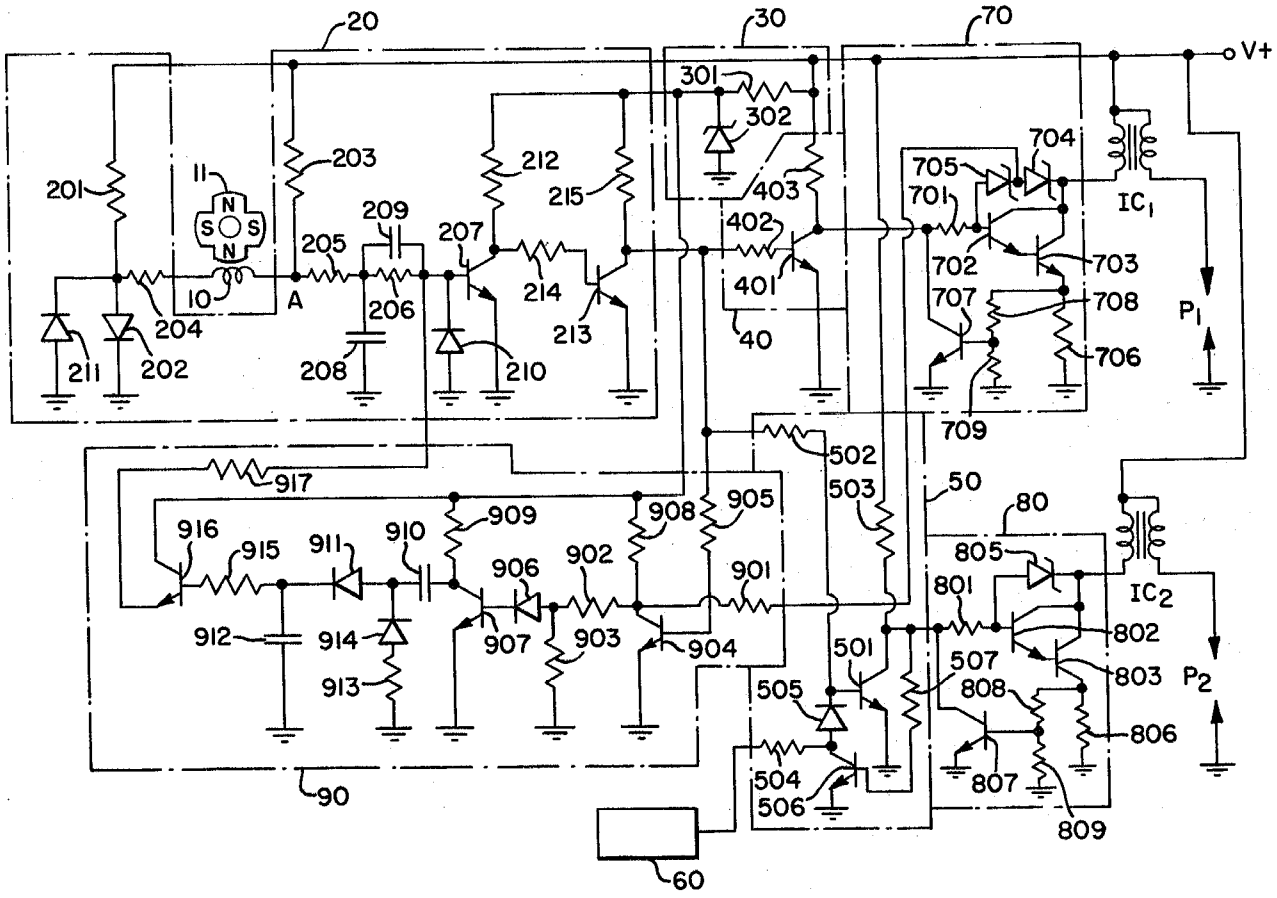
FIG. 1 shows a circuit diagram of an embodiment of an ignition circuit in accordance with the present invention.

Referring now to FIG. 1, a transistorized ignition apparatus according to the present invention has a pick-up coil 10 across which is produced an alternating voltage signal in response to the rotation of a magnet rotor 11 which is mechanically connected to a crank shaft of an internal combustion engine, and to produce sparks at dual spark plugs $P_1$ and $P_2$ within a cylinder. The alternating voltage signal synchronized with the rotation of the engine is applied to a wave-form shaping circuit 20 as an ignition timing signal VP.

A positive D-C voltage V+ of a voltage source, in the wave-form shaping circuit 20, is applied across a resistor 201 and a diode 202 which are connected in series. In parallel to the resistor 201, a series connection of a resistor 203, the pick-up coil 10 and a resistor 204 is provided and a voltage appearing at the juncture designated by A, i.e. the forward voltage drop across the diode 202 and the ignition timing signal VP, is applied over series-connected resistors 205 and 206 to a base of the transistor 207 having an emitter directly grounded. Ordinarily the forward voltage drop across the diode 202 and that across the base-emitter junction of the transistor 207 are very small and may be negligible, and the resistances of the resistors 203, 204, 205 and 206 are so adjusted that a small amount of bias current flows into the base of the transistor 207 under the condition that a null voltage is produced across the pick-up coil 10. A condenser 208 is adapted to remove noises induced in the circuitry and a speed-up condenser 209 is provided in parallel to the resistor 206. Further, two diodes 210 and 211 are provided, i.e. the former being connected in parallel and in reverse direction to the base-emitter junction of the transistor 207 and the latter in parallel and in reverse direction to the diode 202. Therefore, a current flows into the base of the transistor 207 when the alternating voltage signal is positive, while it is shunted through the diodes 202 and 210 when the voltage is negative. The collector of the transistor 207 is connected with a constant voltage over a resistor 212 at the same time to a base of a transistor 213 which forms an inverter circuit over a resistor 214. An emitter of the transistor 214 is directly grounded and the collector thereof connected with the constant voltage over a resistor 215.

A constant voltage circuit 30 includes a resistor 301 and a reversed Zener diode 302 connected in series. The positive D-C voltage V+ of the voltage source is applied across the series-connected resistor 301 and Zener diode 302, and the constant voltage mentioned above is provided at the juncture therebetween.

An output signal of the wave-form shaping circuit 20 is led into two driver circuits 40 and 50, in each of which predetermined amplification of the signal is performed. The driver circuit 40 has a transistor 401 of a grounded-emitter amplifier circuit, i.e. the emitter being grounded, the base being provided with the collector voltage of the transistor 213 of the wave-form shaping circuit 20 over a resistor 402 and the collector being connected with the positive D-C voltage V+ over a resistor 403.

The driver circuit 50 also has a grounded-emitter amplifier circuit formed with a transistor 501 and two resistors 502 and 503, and to the base of the transistor 501 is applied the collector voltage of the transistor 214 of the wave-form shaping circuit 20 over the resistor 502 to be amplified thereby. This driver circuit 50 further contains a circuit for inhibiting the spark plug $P_2$ from producing sparks upon the receipt of an output from a means 60. This means 60 can be constructed with for example a vacuum switch or a neutral switch, and is provided for detecting that there is no need for sparks at the spark plug $P_2$. Thus, it produces the output under the condition that relative low output power of the engine is required, for example when the engine runs idle or an acceleration pedal is not depressed. The output from the means 60 is applied over a resistor 504 and a diode 505 to the base of the transistor 501, while it is shunted to ground over the collector-emitter of the transistor 506. The base of the transistor 506 is connected to the collector of the transistor 501 over a resistor 507.

When the transistor 501 is in a non-conductive state, a voltage near the positive D-C voltage V+ is applied to the base and the transistor 506 is rendered conductive. Thereby, even if being produced by the inhibiting means 60, the output is shunted to ground over the collector-emitter of the transistor 506 until the transistor 501 is turned on again. Once the transistor 501 is turned on, the transistor 506 is turned off and the output from the inhibiting means 60 is led to the base of the transistor 501. And the transistor 501 is held at the conductive state during the time that the inhibiting means 60 produces the output irrespective of the output signal from the wave-form shaping circuit 20.

Output signals of the driver circuits 40 and 50, i.e. the collector voltages of the transistors 401 and 501, are applied to power transistor circuits 70 and 80, respectively.

In the power transistor circuit 70, the collector voltage of the transistor 401 of the driver circuit 40 is applied over a resistor 701 to the base of a transistor 702 with which a power transistor 703 forms Darlington connection. Thus, the collector and the emitter of the transistor 702 are connected to the collector and the base of the power transistor 703, respectively. For the purpose of protecting the power transistor 703 from breakdown, series-connected Zener diodes 704 and 705 are provided between the base of the transistor 702 and the collector of the power transistor 703. The base of the power transistor 703 is grounded over a resistor 706. This power transistor circuit 70 further contains a current limitter circuit formed with a transistor 707 and series-connected resistors 708 and 709. A part of the output signal from the driver circuit 40 is shunted over the collector-emitter of the transistor 707 to ground depending on the amount of an emitter current of the power transistor 703. Thus, the series-connected resistors 708 and 709 are connected to the emitter of the power transistor 703 in parallel to the resistor 706 so as to detect the amount of the emitter current, and a voltage appearing across the resistor 706 and divided by the series-connected resistors 708 and 709 is applied to the base of the transistor 707.

The positive D-C voltage V+ is connected over a primary coil of an ignition coil $IC_1$ to the collector of the power transistor 703 as well as to the spark plug $P_1$ over a secondary coil thereof.

The power transistor circuit 80 has the same construction as the above-described power transistor circuit 70 except that only a Zener diode 805 provided between the base of a transistor 802 and the collector of a power transistor 803 for protecting the power transistor from breakdown. This power transistor circuit 80 also includes resistors 801 and 806, and a current limitter circuit composed of a transistor 807 and series-connected resistors 808 and 809. And the positive D-C voltage V+ is also connected to the collector of the power transistor 803 over a primary coil of an ignition coil $IC_1$ as well as to the spark plug $P_2$ over a secondary coil thereof.

In the power transistor circuit 70, when the output of the driver circuit 40 is at high level i.e. the transistor 401 is in a non-conductive state, the power transistor 703 of the Darlington connection is rendered into a conductive state and a current begines to flow therethrough. The emitter current of the power transistor 703 flows into the resistor 706 and increases its amount gradually. The voltage across the resistor 706, which is divided by the resistors 708 and 709 and applied to the base of the transistor 707, causes a base current to flow therein. Depending on that base current, the transistor 707 is rendered conductive and a part of the output from the driver circuit 40 is shunted to ground therethrough. Thus, the operating condition of the power transistor 703 is drawn from a saturation region back to a non-saturation (or active) region, thereby current flowing therethrough is limitted under a predetermined maximum value $I_{MAX1}$. And during of the operation in the non-saturation region, the collector voltage of the power transistor 703 becomes greater than that which appears in the saturation region. Also, the current flowing through the power transistor 803 is limitted under a predetermined maximum value $I_{MAX2}$ by the current limitter circuit thereof.

The maximum value $I_{MAX1}$ as well as the maximum value $I_{MAX2}$ can be adjusted by selecting the resistances of the resistors 708 and 709 and 808 and 809. According to this embodiment, the maximum value $I_{MAX1}$ is preset at a value less than the maximum value $I_{MAX2}$. Therefore, a current through the power transistor 703 is saturated always before that flowing through the power transistor 803, and the operation condition of the power transistor 703 is drawn back to the non-saturation region before the operation condition of the power transistor 803.

A non-saturation time-to-voltage converting circuit 90 is provided as a feedback element between the power transistor circuit 70 and the wave-form shaping circuit 20. The collector voltage of the power transistor 703 is applied through the Zener diode 704 and a resistor 901 across series-connected resistors 902 and 903. The Zener diode 704 is adapted to detect the operation condition of the power transistor 703 as well as the protection of the power transistor. Thus, when the power transistor 703 operates in the non-saturation region and at the same time the collector voltage increases abruptly, a current flows into the series-connected resistors 902 and 903 over the Zener diode 704. In parallel to the series-connected resistors 902 and 903, a transistor 904 is provided, to the base of which the output signal of the wave-form shaping circuit 20 is applied over a resistor 905. Therefore, when the transistor 213 is in the non-conductive state, the transistor 904 is rendered into conductive and the current flowing over the Zener diode 704 is shunted into ground therethrough, on the other hand when the transistor 213 in the conductive state, the current flows into the series-connected resistors 902 and 903. The voltage across the resistor 903 is applied over a diode 906 to the base of a transistor 907, the emitter of which is directly grounded. The collectors of the transistor 904 and 907 are connected with the constant voltage from the constant voltage circuit 30 through resistors 908 and 909, respectively. The resistances of the resistors 901, 902, 903 and 908 are so selected that the transistor 904 is turned on by the collector voltage appearing when the power transistor 703 operates in the non-saturation region. In parallel to the transistor 907, a series connection of a condenser 910, a diode 911 and a condenser 912 is provided. The constant voltage from the constant voltage circuit 30 is applied across the resistor 909 and the series connection of 910, 911, and 912, and these condensers 910 and 912 are charged up to their respective voltages. When the transistor 907 is turned on, an electric charge stored in the condenser 910 is discharged through a resistor 913 and a diode 914. After this discharge, when the transistor 907 is turned off, a charge current flows into the condenser 910 to charge it up to the previous voltage again. This charge current also flows into the condenser 912, thereby to increase the electric charge stored therein. The voltage across the condenser 912 is applied through a resistor 915 to the base of a transistor 916. The collector of the transistor 916 is connected with the constant voltage of the constant voltage circuit 30, and the emitter thereof connected over a resistor 917 to the base of the transistor 207 of the wave-form shaping circuit 20. Consequently, the current, which depends on the voltage across the condenser 912, flows through the resistor 917 into the base of the transistor 207 of the wave-form shaping circuit 20, thereby controlling an operating level of the transistor 207.

Figure 2:
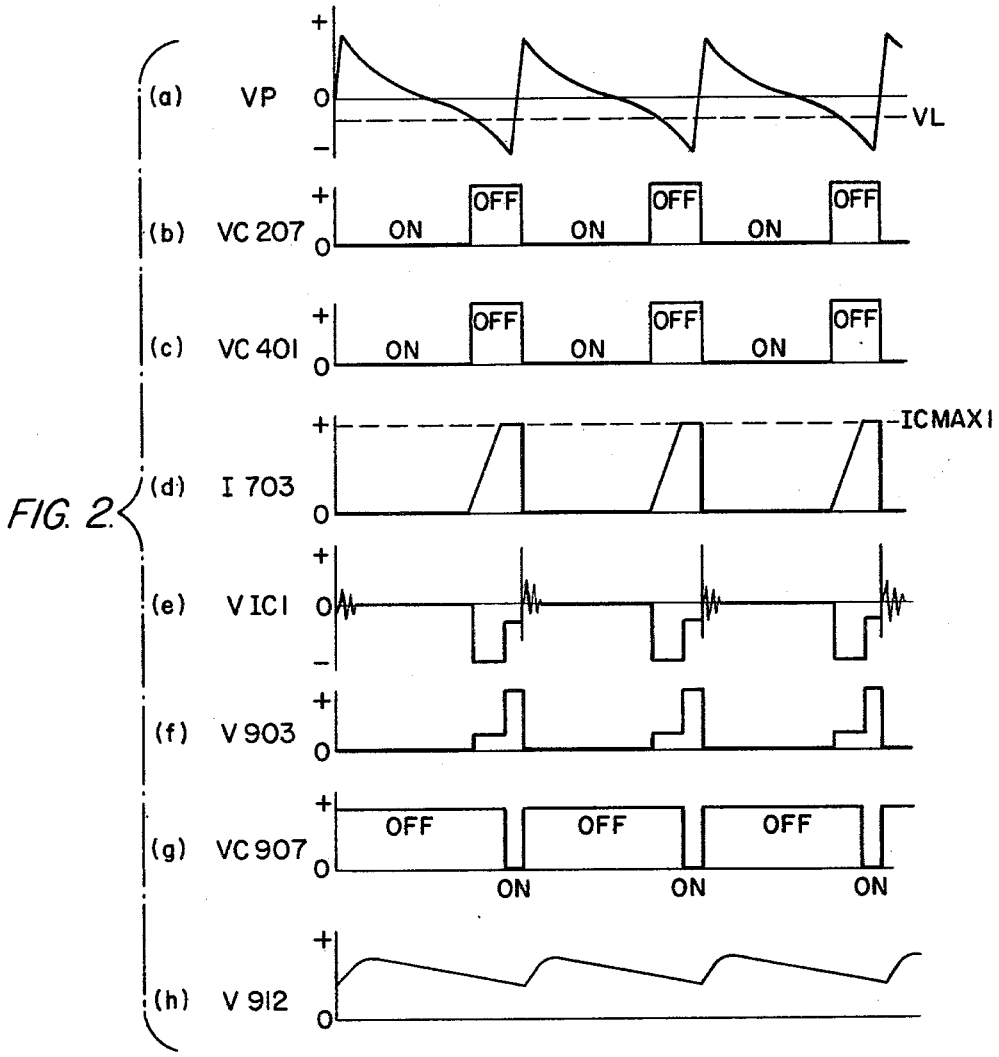
FIG. 2 shows wave-forms of signals appearing at various points in the embodiment shown in FIG. 1.

Referring to FIG. 2, the operation of the above embodiment will be given more in detail hereinafter. Across the pick-up coil 10, the alternating voltage signal or the ignition timing signal VP is produced as shown in FIG. 2(*a*), which is synchronous to the rotation of the engine. Under the condition that a null current flows into the transistor 916, the transistor 207 is turned on in the positive state of the ignition timing signal VP. The operating level VL of the transistor 207 is inherently determined by the base-emitter forward voltage drop thereof, but in this circuit it is actually determined according to the output voltage across the pick-up coil 10 and the voltage across the condenser 912. While the engine is in operation, since a current flows through the transistor 916 and the resistor 917, the operating level VL of the transistor 207 is shifted toward negative. The operating level VL is designated by a broken-line in FIG. 2(*a*), and determines the conduction period of power transistors including the conduction starting point and the conduction finishing point. Therefore, when the voltage at the point A or the ignition timing signal VP falls below the operating level VL, the transistor 207 is turned off. FIG. 2(*b*) shows a collector voltage $VC_{207}$ of the transistor 207. With the high level of the collector voltage $VC_{207}$, the transistor 213 is turned on.

Under the condition that no output is produced from the inhibiting means 60 and the transistor 213 is turned on, both the transistors 401 and 501 of the driver circuits 40 and 50 are turned off. As an example, the collector voltage $VC_{401}$ of the transistor 401 is shown in FIG. 2(*c*). With the high level of the collector voltages of the transistors 401 and 501, the power transistors 703 and 803 of the Darlington connection are turned on, and gradually increasing currents begins to flow therethrough. The current $I_{703}$ flowing through the power transistor 703 is shown in FIG. 2(*d*). These currents are restricted under the respective maximum values $I_{MAX1}$ and $I_{MAX2}$ by the function of the current limiter circuits mentioned above. However, since the maximum value $I_{MAX1}$ is preset at the value less than the maximum value $I_{MAX2}$, the current flowing through the power transistor 703 is saturated always before the current through the power transistor 803. These currents also flow into the primary coils of the ignition coils $IC_1$ and $IC_2$ and induce secondary voltages across the respective secondary coils thereof. FIG. 2(*e*) shows the secondary voltage $V_{100}$ across the secondary coil of the ignition coil 100. When the power transistor 703 operates in the saturation region, a relatively low voltage appears at the collector thereof. However, once it is drawn back into the non-saturation region, a relatively high voltage appears.

When the transistor 207 is turned off, the transistor 904 is also in the non-conductive state, therefore, the collector voltage of the power transistor 703 being applied across the series-connected resistors 902 and 903 over the Zener diode 704 and the resistor 901. Under the saturated condition, the collector voltage is suppressed to the low value so that enough voltage to turn on the transistor 907 is not applied across the resistor 903. Therefore, the condensers 910 and 912 are charged up with the constant voltage until the transistor 907 is turned on. When the operation of the power transistor 703 is drawn back into the non-saturation region, current flowing into the series-connected resistors 902 and 903 abruptly increases as the collector voltage thereof and produces enough voltage to turn on the transistor 907 across the resistor 903. The conductive state of the transistor 907 is held until the transistor 207 is turned on. Therefore, the electric charge stored in the condenser 910 is discharged through the resistor 913 and the diode 914 during the duration of the conductive state of the transistor 907, i.e. during the time the power transistor 703 operates in the non-saturation region. FIG. 2(*f*) shows the voltage $V_{903}$ across the resistor 903 and FIG. 2(*g*) the collector voltage $VC_{907}$ of the transistor 907.

When the ignition timing signal VP turns its voltage from the negative up to the operating level VL, the transistor 207 is turned on whereas the transistor 213 turned off. Then the transistors 401 and 501 are turned on and the power transistors 703 and 803 turned off. Therefore, the primary currents through the primary coils of the ignition coils $IC_1$ and $IC_2$ decreases abruptly. In response to the abrupt decrease of the primary currents, high positive voltages are induced across the secondary coils and produce aparks at the spark-plugs $P_1$ and $P_2$.

In the above state, the transistor 904 is in the conductive state with the high collector voltage of the transistor 213 which is turned on. And the transistor 907 is rendered into the non-conductive state because of the low collector voltage of the transistor 904. Therefore, the condenser 910 is prevented from discharging and begins to be charged with the constant voltage again. At the same time, charge current flows into the condenser 910 as well as the condenser 912. The duration during which the charge current flows is determined by the amount of the electric charge which is discharged previously i.e. the duration of the non-saturated operation of the power transistor 703. By this charge current, the condenser 912 is overcharged with an additional electric charge relative to the duration of the non-saturated operation of the power transistor 703. FIG. 2(*h*) shows the voltage $V_{912}$ across the condenser 912. The transistor 916 supplies the amount of current dependent on the voltage $V_{912}$ across the condenser 912, and therefore controls the operating level of the transistor 207, i.e. the conduction starting point of the power transistors 703 and 803, depending on the duration of the non-saturated operation of the power transistor 703.

In accordance with the embodiment shown in FIG. 1, the detection of the non-saturated operation of the power transistor is achieved by monitoring the increase of the collector voltage thereof. However, there are another measures to detect the non-saturated operation other than that.

Figure 3:
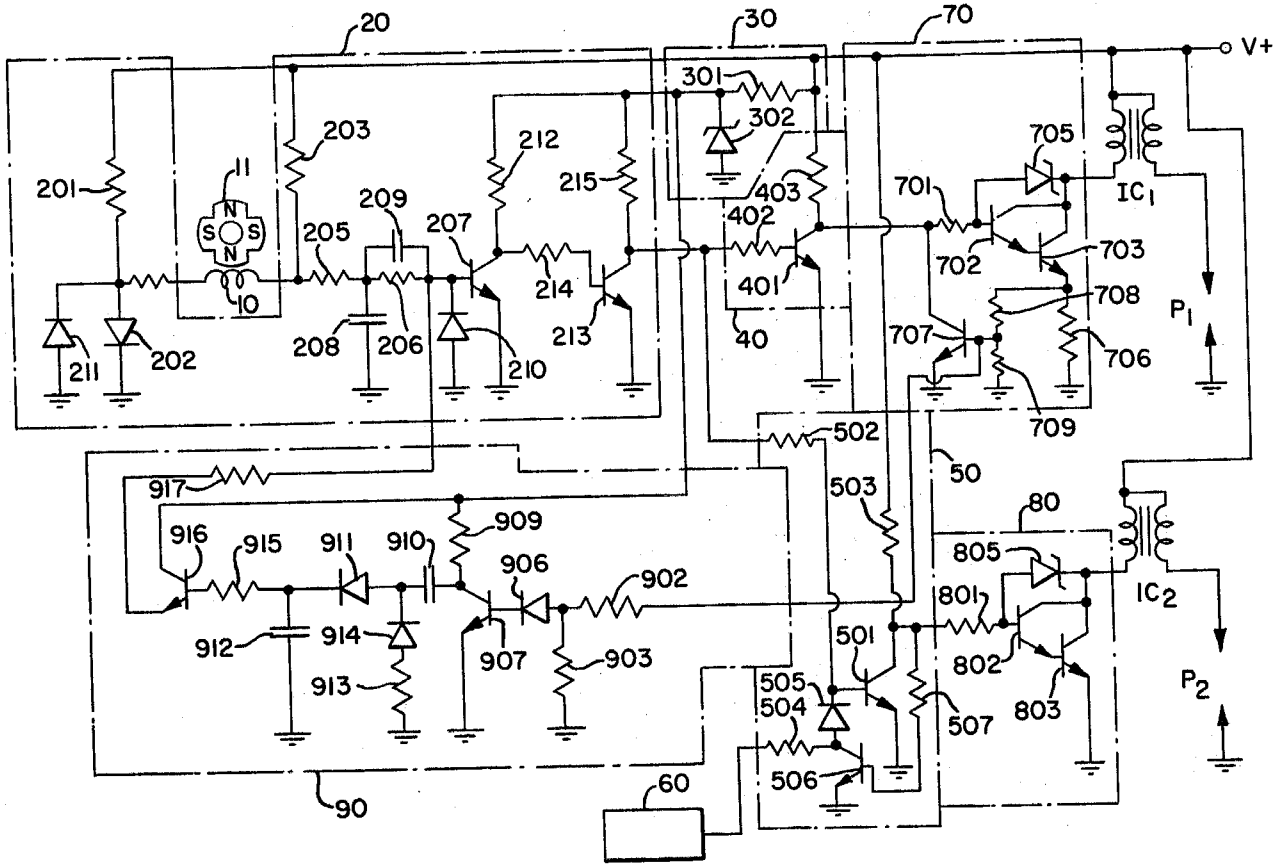
FIG. 3 shows a circuit diagram of one modification of the embodiment shown in FIG. 1.

Referring now to FIG. 3, wherein like reference numerals indicate like elements in FIG. 1, the ignition apparatus also has a pick-up coil 10, a magnetic rotor 11, a wave-form shaping circuit 20, a constant voltage circuit 30, driver circuits 40 and 50, an inhibiting means 60, power transistor circuits 70 and 80, a non-saturation time-to-voltage converting circuit 90, ignition coils $IC_1$ and $IC_2$ and spark plugs $P_1$ and $P_2$. Particularly, the wave-form shaping circuit 20, the constant voltage circuit 30, and the driver circuits 40 and 50 have the same constructions as those shown in FIG. 1. The power transistor circuit 70 also has almost same construction to that shown in FIG. 1 except that only one Zener diode 705 is provided between the base of the transistor 702 and the collector of the power transistor 703. On the other hand, the power transistor circuit 80 does not include a current limitter circuit but the Darlington connection of a transistor 802 and a power transistor 803. The emitter of the power transistor 803 being grounded directly, and a Zener diode 805 is also provided between the base of the transistor 802 and the collector of the power transistor 803. Therefore, a current flowing through the power transistor 703 is saturated always before that flowing through the power transistor, and only the operation condition of the power transistor 803 is drawn back into the non-saturation region. According to this modification shown in FIG. 2, the non-saturated operation of the power transistor 703 is detected by monitoring the voltage appearing at the juncture between the series-connected resistors 708 and 709 through which a part of the emitter current of the power transistor 703 flows. Thus, the voltage at that juncture is directly applied across series-connected resistors 902 and 903 of the non-saturation time-to-voltage converting circuit 90. And the resistances of the resistors 901, 902 and 903 are so adjusted that a transistor 907 is turned on when the emitter current increases near being saturated. Therefore, the transistor 907 is in the conductive state during the non-saturated operation of the power transistor 703. The construction of the converting circuit 90 is almost like to that in FIG. 1 except for that mentioned above. The conduction starting point of the power transistors 703 and 803 is controlled depending on the duration of the non-saturated operation of the power transistor 703.

Figure 4:
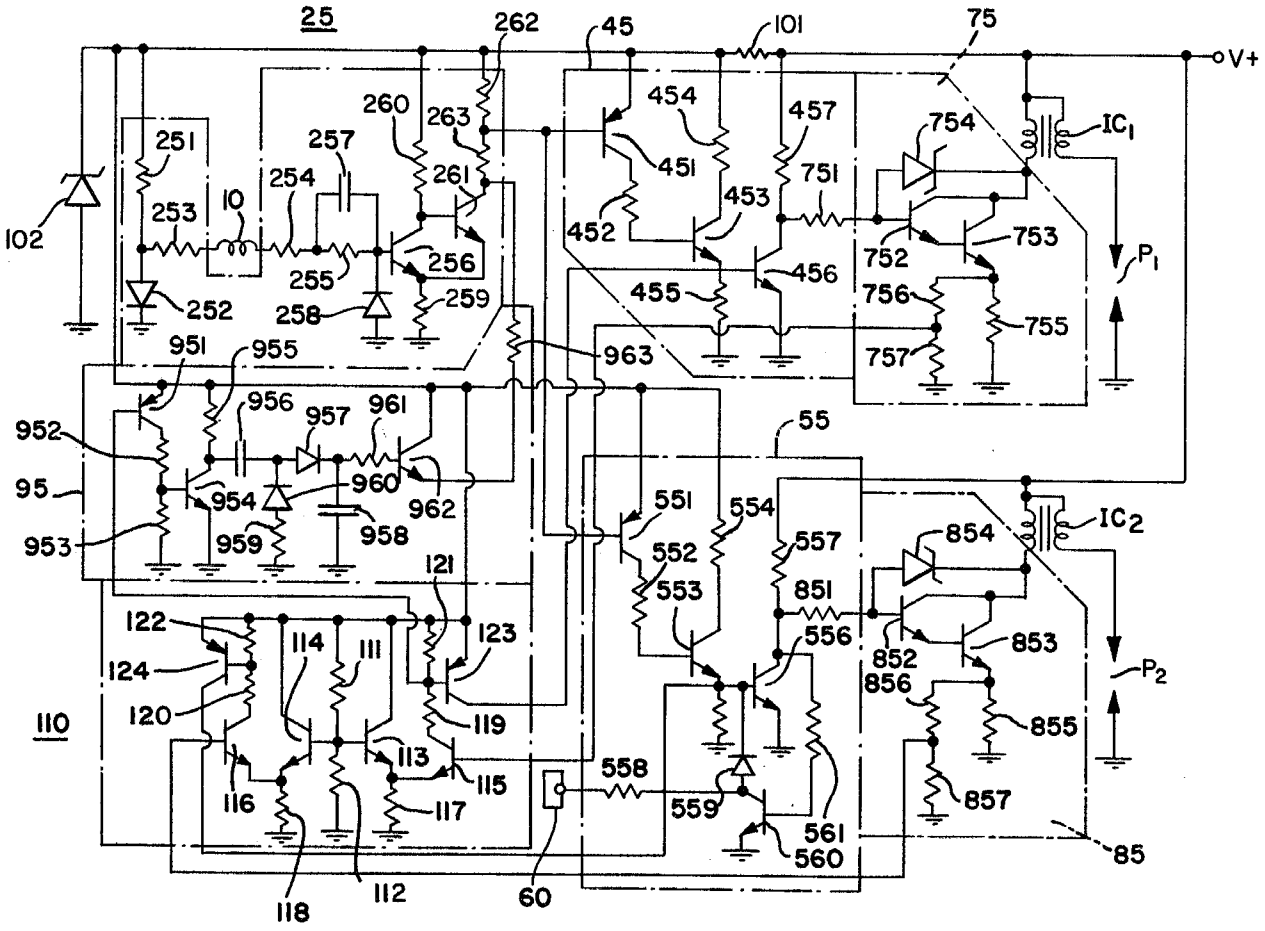
FIG. 4 shows a circuit diagram of an another embodiment of the present invention.

In FIG. 4, there is shown an another embodiment according to the present invention, wherein a transistor means a NPN transistor if not otherwise indicated.

A positive D-C voltage V+ of a voltage source is applied across a resistor 101 and a Zener diode 102 connected in series, and a constant voltage is provided across the Zener diode 102.

Figure 5:
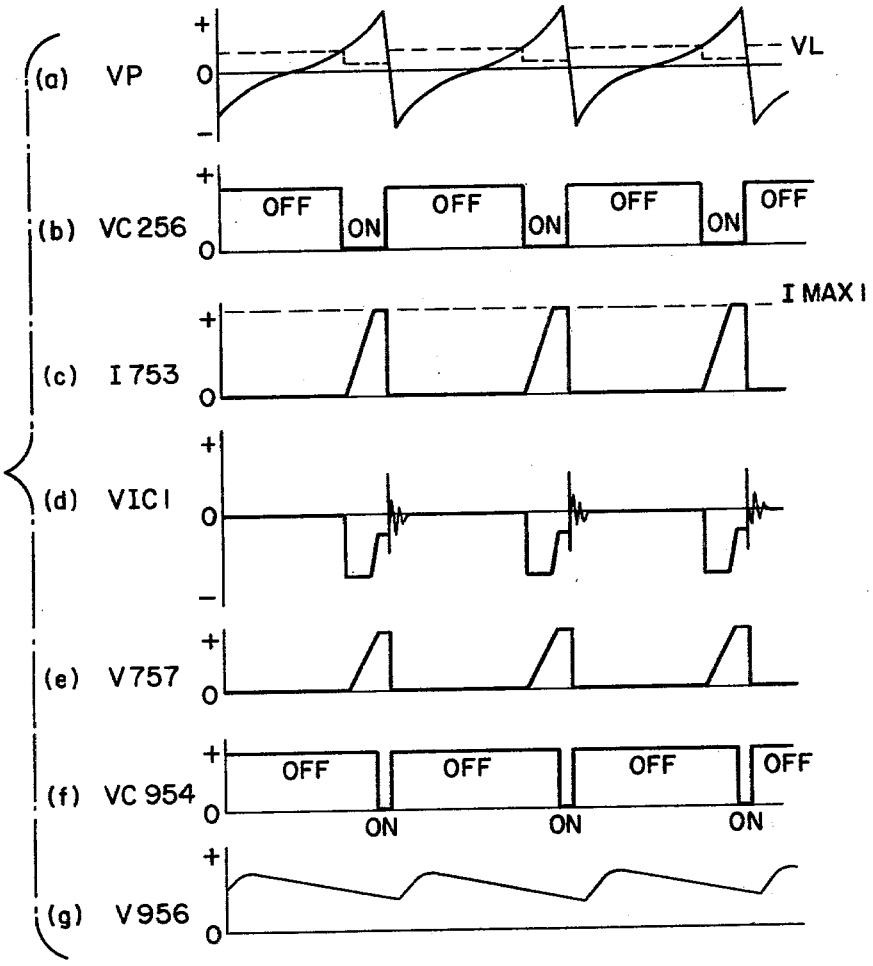
FIG. 5 shows wave-forms of signals appearing at various points in the embodiment shown in FIG. 4.

Across a pick-up coil 10, an alternating voltage signal is induced in response to the rotation of a magnet rotor 11 which is mechanically connected to a crank shaft of the engine. The alternating voltage signal is applied to a wave-form shaping circuit 25 as an ignition timing signal VP which is shown in FIG. 5(*a*).

The constant voltage across the Zener diode 102 is applied across a resistor 251 and a diode 252 which are connected in series. An anode of the diode 252 is connected through resistor 253, the pick-up coil 10 across which the ignition timing signal VP is produced, and resistors 254 and 255 to the base of a transistor 256. A speed-up condenser 257 is connected in parallel to the resistor 255 and a reversed diode 258 is adapted at the base of the transistor 256. The emitter of the transistor 256 is grounded through a resistor 259 and the collector thereof connected with the constant voltage over a resistor 260. The resistances of the resistors 251, 253, 254, 255 and 259 are so adjusted that a small amount of bias current flows into the base of the transistor 256 when a null voltage is produced across the pick-up coil 10. A current flows into the base of the transistor 256 when the alternating voltage signal (the ignition timing signal VP) lies in the positive range, while it is shunted through the diodes 252 and 258 to ground when the voltage is negative. The voltage, which appears between the collector-emitter of the transistor 256 as shown in FIG. 5(*b*), is applied between the base-emitter of a transistor 261, the collector of which is connected with the constant voltage over series-connected resistors 262 and 263. And an output appears at the juncture between the resistors 262 and 263.

The output of the wave-form shaping circuit 25 mentioned above is led into both driver circuits 45 and 55. In the driver circuit 45, the output is applied to the base of a PNP transistor 451. The emitter of the PNP transistor 451 is directly connected with the constant voltage across the above-mentioned Zener diode 102, and the collector thereof is connected through a resistor 452 to the base of a transistor 453 which is also connected with the constant voltage at the collector through a resistor 454. The emitter of the transistor 453 is connected through a resistor 455 to ground, a voltage across which resistor is applied to the base of a transistor 456. The transistor 456 is connected with the positive D-C voltage V+ at the collector through a resistor 457 and the emitter thereof is directly grounded.

The driver circuit 55 is also completed with a PNP transistor 551, a resistor 552, a transistor 553, resistors 554 and 555, a transistor 556 and a resistor 557 in the same manner as the driver circuit 45. This driver circuit 55 further contains an inhibiting circuit for inhibiting the spark plug $P_2$ from producing sparks upon the receipt of an output from a means 60. This means is the same as that of the embodiment shown in FIG. 1 in the construction and the function. The output from the means 60 is applied over a resistor 558 and a diode 559 to the base of the transistor 556 whereas it is shunted to ground through a transistor 560 which is controlled by the collector voltage of the transistor 556, which is applied over a resistor 561 to the base. Thus, the transistor 556 is held at the conductive state irrespective of the output signal from the wave-form shaping circuit 25 if the means 60 produces the output and the transistor 556 is in the conductive state.

Two power transistor circuits 75 and 85 are provided for driving ignition coils $IC_1$ and $IC_2$ in response to outputs signals from the driver circuits 45 and 55. Only the construction of the power transistor circuit 75 is detailed hereinafter since it is similar to that of the circuit 85 as is apparent from the figure. The collector voltage of the transistor 456 is applied over a resistor 751 to the base of a transistor 752 with which a power transistor 753 forms the Darlington connection. Between the collector of the power transistor 753 and the base of the transistor 752, a Zener diode 754 is provided for protecting them from breakdown, and the base of the power transistor 753 is grounded through a resistor 755. This circuit 75 further contains series-connected resistors 756 and 757 which are adapted at the base of the power transistor 753 in parallel to the resistor 755. The power transistor 753 is connected with the positive D-C voltage V+ at the collector, and supplies a current which is shown in FIG. 5(*c*) to the primary coil of the ignition coil $IC_1$ in response to the output from the driver circuit 45. Therefore, a voltage is induced across the secondary coil in response to the primary current. This voltage across the secondary coil is shown in FIG. 5(*d*). At the same time, a voltage proportional to the amount of the primary current appears at the juncture between the series-connected resistors 756 and 757 as shown in FIG. 5(*e*).

The power transistor circuit 85 is composed of a resistor 851, a transistor 852 and a power transistor 853 of the Darlington connection, a Zener diode 854, a resistor 855 and a series-connected resistors 856 and 857, and has the same construction as the power transistor circuit 75 detailed above. Also, a voltage proportional to the amount of the primary current of the ignition coil $IC_2$ appears at the juncture between the series-connected resistors 856 and 857.

These voltages at the junctures are led into a current limitter circuit 110 which includes two comparators. Thus, the constant voltage across the Zener diode 102 is applied across series-connected resistors 111 and 112, and a reference voltage is obtained across the resistor 112. The reference voltage is applied to both the bases of the transistors 113 and 114 which are connected with the constant voltage at the respective collectors. Transistors 115 and 116 are provided in the faces of the transistors 113 and 114 in pairs. A pair of the transistors 113 and 115 in grounded through a resistor 117 at the emitters, and the other pair of the transistors 114 and 116 through a resistor 118. These transistors 115 and 116 are connected with the constant voltage at the collectors over respective pairs of resistors 119 and 121 and 120 and 122 each connected in series. The juncture voltages from the power transistors circuit 75 and 85 are applied to the base of the transistor 115 and 116, respectively. Further, there are provided two PNP transistors 123 and 124, i.e. the base-emitter junction of the PNP transistor 123 being connected across the resistor 121 and that of the PNP transistor 124 across the resistor 122. The collector of the PNP transistor 123 is connected to the base of the transistor 456 of the driver circuit 45 and that of the PNP transistor 124 to the base of the transistor 556 of the driver circuit 55.

Just as the voltage at the juncture between the resistors 756 and 757 increases, the base voltage of the transistor 115 increases in accordance with the increase of the emitter current of the power transistor 753. When the base voltage exceeds the reference voltage determined by the resistors 111 and 112, the transistor 115 and the PNP transistor 123 are turned on. Through the PNP transistor 123, a current flows into the resistor 455 to provide a voltage and render the transistor 456 of the driver circuit 45 conductive. With the low level of the collector voltage of the transistor 456, the power transistor 753 is turned off and the emitter current abruptly decreases. When the emitter current decreases and the voltage at the juncture between the resistor 756 and 757 falls below the reference voltage, the transistor 115 and the PNP transistor 123 are turned off again. Since no current flows into the resistor 455, the transistor 456 is turned off whereas the power transistor 753 turned on, and the emitter current increases. This is repeated, thereby the current through the power transistor 753 is saturated at the maximum value $I_{MAX1}$ as shown in FIG. 5(*c*). Thus, the operation of the power transistor 753 is drawn from the saturation region back into the non-saturation region by the current limitter circuit 110. On the other hand, the primary current of the ignition coil $IC_2$ is also restricted under the maximum value $I_{MAX2}$ by the function of the current limitter circuit in the similar manner mentioned above. However, since the maximum value $I_{MAX1}$ is preset at the value lower than the maximum value $I_{MAX2}$, the primary current through the power transistor 753 is saturated always before the current through the power transistor 853 is saturated.

The voltage signal, which appears at the juncture between the resistors 119 and 121 of the current limitter circuit 110, is further applied to the base of a PNP transistor 951 of a non-saturation time-to-voltage converting circuit 95. The collector of the PNP transistor 951 is connected with the constant voltage across the Zener diode 102 and the emitter thereof connected to ground through resistors 952 and 953 and to the base of the transistor 954 having the emitter directly grounded and the collector connected with the constant voltage over a resistor 955. In parallel to the transistor 954, a series connection of a condenser 956, a diode 957 and a condenser 958 is provided. The constant voltage is applied across the resistor 955 and the series connection, thereby the condensers 956 and 958 are charged up to the respective voltages. When the transistor 954 is turned on, an electric charge stored in the condenser 956 is discharged through a resistor 959 and a diode 960. After this charge, when the transistor 954 is turned off, a charge current flows into the condenser 956 to charge it up to the previous voltage again. This charge current also flows into the condenser 958, therefore storing more electric charge therein. The collector voltage $VC_{954}$ of the transistor 954 and the voltage $V_{956}$ across the the condenser 956 are shown in FIGS. 5(*f*) and (*g*), respectively. The voltage across the condenser 958 is applied through a resistor 961 to the base of a transistor 962. The collector of the transistor 962 is connected with the constant voltage and the emitter thereof connected through a resistor 963 to the collector of the transistor 261 of the wave-form shaping circuit 25. Therefore, a current supplied with the transistor 962 depending on the voltage across the condenser 958 controls the operation level of the transistor 256. Thus, when the transistor 256 is turned off and the transistor 261 turned on, the current flows through the collector-emitter of the transistor 261 into the resistor 259 which is connected at the emitter of the transistor 256. Thus, the current produces a voltage across the resistor 259 and increase the emitter voltage of the transistor 256. Therefore, the operation level of the transistor 256 is shifted up to positive according to the voltage across the condenser 958. This operation level is shown in FIG. 5(*a*) by a broken-line.

While, the duration during which the charge current flows into the condenser 958 is relative to the duration of the non-saturated operation of the power transistor 753. The condenser 958 is overcharged with an additional electric charge depending on the duration of the non-saturated operation of the power transistor 753.

What we claim:

1. A transistorized ignition apparatus for driving two ignition coils of an internal combustion engine comprising:

two power transistor circuits, each having a power transistor for supplying primary current to the corresponding one of the ignition coils;

a pick-up coil for generating an ignition timing signal in response to the operation of the engine;

a wave-form shaping circuit for determining the conduction period of the power transistors of said power transistor circuits on the basis of the ignition timing signal from said pick-up coil;

two driver circuits, each for producing a driving signal to corresponding one of said power transistor circuits on the receipt of an output from said wave-form shaping circuit;

means, each provided for corresponding one of said power transistor circuits and for restricting the current through the power transistor thereof under respective maximum values, wherein one maximum value is preset at the value lower than the other;

means for detecting the duration of the restriction during which the current is restricted under the lower maximum value; and a feedback circuit for controlling the conduction period of the power transistors determined by said wave-form shaping circuit depending on an output from said duration detecting means.

2. A transistorized ignition apparatus as claimed in claim 1, wherein said each restricting means consists of means for detecting the amount of the current flowing through the power transistor and transistor input signal control means for controllably decreasing an input which is applied to a base of said power transistor depending on an output from said means for detecting said amount of said current.

3. A transistorized ignition apparatus as claimed in claim 2, wherein said restriction duration detecting means monitors a power transistor collector voltage of the power transistor.

4. A transistorized ignition apparatus claimed in claim 1, which further comprises; means for inhibiting one of said power transistors from being driven only when the engine is under a certain condition, said one of the power transistors being selected to be other than the power transistor connected with the restricting means which restricts the current therethrough under said lower value of said respective maximum value.

5. A transistorized ignition apparatus claimed in claim 4, wherein said inhibiting means inhibits one of said driver circuits from producing the driving signal.

6. A transistorized ignition apparatus for driving two ignition coils of an internal combustion engine comprising:

two transistor circuits, each having a power transistor and for supplying primary current to the corresponding one of the ignition coils;

a pick-up coil for generating an ignition timing signal in response to the operation of the engine;

a wave-form shaping circuit for determining the conduction period of the power transistors of said power transistor circuits on the basis of the ignition timing signal from said pick-up coil;

two driver circuits, each for producing a driving signal to corresponding one of said power transistor circuits on the receipt of an output from said wave-form shaping circuit;

a plurality of current restricting means, each provided for a corresponding one of said power transistor circuits, for restricting the current through the power transistor thereof under a respective maximum value;

means for detecting the duration of the restriction during which the current is restricted by one of said current restricting means to which the lowest value of said respective maximum value is present; and a feedback circuit for controlling the conduction period of the power transistors determined by said wave-form shaping circuit depending on an output from said duration detecting means.

7. A transistorized ignition apparatus claimed in claim 6, which further comprises;

means for inhibiting one of said power transistors from being driven only when the engine is under a certain condition, said one of the power transistors being selected to be other than the power transistor connected with the restricting means which restricts the current therethrough under said lowest value of said restrictive maximum value.

8. A transistorized ignition apparatus claimed in claim 7, wherein said inhibiting means inhibits one of said driver circuits from producing the driving signal.

* * * * *